US008146662B2

(12) United States Patent
Shoemate

(10) Patent No.: US 8,146,662 B2
(45) Date of Patent: Apr. 3, 2012

(54) WELL SCREEN ASSEMBLY WITH MULTI-GAGE WIRE WRAPPED LAYER

(75) Inventor: Jacob Shoemate, Ponder, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 249 days.

(21) Appl. No.: 12/420,514

(22) Filed: Apr. 8, 2009

(65) Prior Publication Data

US 2010/0258300 A1 Oct. 14, 2010

(51) Int. Cl.
*E21B 43/08* (2006.01)
*E03B 3/20* (2006.01)

(52) U.S. Cl. ... 166/278; 166/233; 166/236; 210/170.01; 210/338; 210/497.01; 210/170.07

(58) Field of Classification Search ..... 166/278, 166/378, 230, 233, 236; 210/170.01, 107.07, 210/338, 497.01, 497.1, 499, 459, 483, 485
See application file for complete search history.

(56) References Cited

U.S. PATENT DOCUMENTS

| | | | | | |
|---|---|---|---|---|---|
| 700,015 | A | | 5/1902 | Carlson | |
| 1,976,217 | A | * | 10/1934 | Diepenbrock | 166/235 |
| 3,908,256 | A | | 9/1975 | Smith, III | |
| 3,958,634 | A | | 5/1976 | Smith, III | |
| 4,204,967 | A | | 5/1980 | Bannister | |
| 4,428,423 | A | * | 1/1984 | Koehler et al. | 166/231 |
| 4,771,829 | A | * | 9/1988 | Sparlin | 166/233 |
| 5,152,892 | A | * | 10/1992 | Chambers | 210/493.4 |
| 5,190,102 | A | | 3/1993 | Arterbury et al. | |
| 5,310,000 | A | | 5/1994 | Arterbury et al. | |
| 5,339,895 | A | | 8/1994 | Arterbury et al. | |
| 5,355,948 | A | * | 10/1994 | Sparlin et al. | 166/228 |
| 5,611,399 | A | | 3/1997 | Richard et al. | |
| 5,624,560 | A | | 4/1997 | Voll et al. | |
| 5,642,781 | A | | 7/1997 | Richard | |
| 5,738,170 | A | | 4/1998 | Lavernhe | |
| 5,787,980 | A | * | 8/1998 | Sparlin et al. | 166/231 |
| 5,849,188 | A | | 12/1998 | Voll et al. | |
| 5,901,789 | A | | 5/1999 | Donnelly et al. | |
| 5,909,773 | A | | 6/1999 | Koehler et al. | |
| 5,918,672 | A | | 7/1999 | McConnell et al. | |

(Continued)

FOREIGN PATENT DOCUMENTS

WO WO 03/100211 12/2003

OTHER PUBLICATIONS

International Search Report and Written Opinion for PCT/US2010/030255 dated Aug. 31, 2010 prepared by Korean Intellectual Property Office, 8 pages.

(Continued)

*Primary Examiner* — Jennifer H Gay
(74) *Attorney, Agent, or Firm* — Joshua A. Griswold

(57) ABSTRACT

A well screen assembly includes an elongate base pipe and a wire wrap layer. The wire wrap layer includes a wire wrapped around support ribs. The wire wrap layer has an axial end section wrapped at a first gage and an intermediate section wrapped at a second, larger gage. A mesh layer is provided around the wire wrap layer. An outer shroud is provided around the mesh layer, the outer shroud sealed to the wire wrap layer.

20 Claims, 3 Drawing Sheets

U.S. PATENT DOCUMENTS

| | | | | |
|---|---|---|---|---|
| 5,938,925 | A * | 8/1999 | Hamid et al. | 210/497.1 |
| 5,979,551 | A * | 11/1999 | Uban et al. | 166/233 |
| 5,980,745 | A * | 11/1999 | Voll et al. | 210/497.01 |
| 6,092,604 | A | 7/2000 | Rice et al. | |
| 6,305,468 | B1 | 10/2001 | Broome et al. | |
| 6,315,040 | B1 | 11/2001 | Donnelly | |
| 6,391,200 | B2 | 5/2002 | Pulek et al. | |
| 6,612,481 | B2 | 9/2003 | Bode | |
| 6,715,544 | B2 | 4/2004 | Gillespie et al. | |
| 6,745,843 | B2 * | 6/2004 | Johnson et al. | 166/386 |
| 6,776,241 | B2 | 8/2004 | Castano-Mears et al. | |
| 6,941,652 | B2 | 9/2005 | Echols et al. | |
| 7,287,684 | B2 | 10/2007 | Blackburne, Jr. | |
| 7,841,409 | B2 | 11/2010 | Gano et al. | |
| 2002/0117440 | A1 * | 8/2002 | Cross et al. | 210/391 |
| 2002/0189808 | A1 | 12/2002 | Nguyen et al. | |
| 2003/0066651 | A1 * | 4/2003 | Johnson | 166/369 |
| 2003/0141061 | A1 | 7/2003 | Hailey, Jr. et al. | |
| 2004/0026313 | A1 | 2/2004 | Arlon Fischer | |
| 2005/0014429 | A1 | 1/2005 | Tueshaus et al. | |
| 2005/0082061 | A1 * | 4/2005 | Nguyen et al. | 166/278 |
| 2005/0126779 | A1 | 6/2005 | Arterbury | |
| 2005/0272329 | A1 | 12/2005 | Tueshaus et al. | |
| 2006/0137883 | A1 | 6/2006 | Kluger et al. | |
| 2006/0186601 | A1 | 8/2006 | Lopez | |
| 2007/0012444 | A1 | 1/2007 | Horgan et al. | |
| 2007/0199889 | A1 | 8/2007 | Tueshaus et al. | |
| 2007/0256834 | A1 | 11/2007 | Hopkins et al. | |
| 2008/0035330 | A1 | 2/2008 | Richards | |
| 2008/0283239 | A1 | 11/2008 | Langlais et al. | |
| 2008/0289815 | A1 | 11/2008 | Moen et al. | |
| 2009/0084556 | A1 | 4/2009 | Richards et al. | |
| 2009/0229823 | A1 * | 9/2009 | Moen et al. | 166/302 |
| 2010/0000742 | A1 | 1/2010 | Bonner et al. | |
| 2010/0122447 | A1 | 5/2010 | Peterson | |
| 2010/0163481 | A1 | 7/2010 | McGrenera et al. | |
| 2010/0252250 | A1 | 10/2010 | Fripp et al. | |
| 2010/0258300 | A1 * | 10/2010 | Shoemate | 166/230 |
| 2010/0258301 | A1 * | 10/2010 | Bonner et al. | 166/230 |
| 2010/0258302 | A1 * | 10/2010 | Bonner et al. | 166/244.1 |

OTHER PUBLICATIONS

"Standard Specification for Industrial Woven Wire Cloth"; ASTM International; Designation E-2016-06; 2006, 29 pages.

G. Gillespie et al. "Collapse and Burst Test Methods for Sand Screens"; SPE 116094 paper presented at the 2008 SPE Conference on Sep. 21-24, 2008; Denver, Co: 15 pages.

G. Gillespie et al. "Screen Development to Withstand 4,000-psi Overbalance, Subhydrostatic Completion in Deepwater GOM Subsea Waterflood Injector Wells", SPE 116091 paper presented at the 2008 SPE Conference on Sep. 21-24, 2008; Denver, CO; 18 pages.

* cited by examiner

WELL SCREEN ASSEMBLY WITH MULTI-GAGE WIRE WRAPPED LAYER

TECHNICAL FIELD

This description relates to well screen assemblies for use in subterranean wellbores.

BACKGROUND

For centuries, wells have been drilled to extract oil, natural gas, water, and other fluids from subterranean formations. In extracting the fluids, a production string is provided in a wellbore, both reinforcing the structural integrity of the wellbore, as well as assisting in extraction of fluids from the well. To allow fluids to flow into production string, apertures are often provided in the tubing string in the section of the string corresponding with production zones of the well. Although perforations allow for ingress of the desired fluids from the formation, these perforations can also allow unwanted materials to flow into the well from the surrounding foundations during production. Debris, such as formation sand and other particulate, can fall or be swept into the tubing together with formation fluid, contaminating the recovered fluid. Not only do sand and other particulates contaminate the recovered fluid, this particulate can cause many additional problems for the well operator. For example, as the particulate flows through production equipment, it gradually erodes the equipment. Unwanted particulate can block flow passages, accumulate in chambers, and abrade components. Repairing and replacing production equipment damaged by particulate inflow can be exceedingly costly and time-consuming, particularly for downhole equipment sometimes located several thousand feet below the earth's surface. Consequently, to guard against particulate from entering production equipment, while at the same time preserving sufficient fluid flow pathways, various production filters and filtration methods have been developed and employed including gravel packs and well screen assemblies.

A number of well screen filtration designs have been employed. A well screen assembly is a screen of one or more layers installed in the well, capable of filtering against passage of particulate of a specified size and larger, such as sand, rock fragments and gravel from surrounding gravel packing. The specific design of the well screen can take into account the type of subterranean formation likely to be encountered, as well as the well-type.

SUMMARY

An aspect encompasses a well screen assembly having an elongate base pipe and a wire wrap layer with a wire wrapped around the base pipe. The wire wrap layer has an axial end section wrapped at a first gage and an intermediate section wrapped at a second, larger gage. A mesh layer is provided around the wire wrap layer. An outer shroud is provided around the mesh filtration layer, the outer shroud sealed to the wire wrap layer.

An aspect encompasses a well screen assembly having a plurality of support ribs and a wire coiled around and bonded to the support ribs. A spacing between adjacent coil windings in end sections of the wire coil are operable to filter against passage of particulate of a specified size, and a spacing between adjacent coil windings in an intermediate section of the wire coil operable to allow particulate of the specified size to pass.

An aspect encompasses a method for making a well screen assembly. In the method an elongate base pipe is fitted with a wire wrap screen layer comprising a wire coil bonded to longitudinal ribs. Adjacent coil windings in a first section of the coil are positioned at substantially zero gage, and coil windings in a second section of the coil wire positioned at a non-zero gage. At least one mesh layer is wrapped over the wire wrap screen layer so that the longitudinal dimension of the mesh layer extends to overlap at least the first coil section. A shroud layer is provided over the at least one mesh layer. The longitudinal dimension of the rigid shroud layer extends to overlap at least the first coil section underlying the at least one mesh layer. The shroud layer is crimped about the first coil section underlying the at least one mesh layer and rigid shroud layer to pinch and seal the at least one mesh layer between the wire wrap screen layer and the rigid shroud layer.

DESCRIPTION OF DRAWINGS

Like reference symbols in the various drawings indicate like elements.

DETAILED DESCRIPTION

Various implementations of a well screen assembly are provided in connection with a base pipe for use in fluid extraction from a subterranean well. Some implementations of the well screen assembly employ an improved wire wrap screen layer design. In multi-layer well screen assemblies employing wire wrap screen layers, it becomes difficult to seal additional layers on top of the wire wrap screen layer, considering that wire wrap designs can provide a poor base for attaching subsequent layers. An improved wire wrap screen layer can employ sections of close wrappings, in some instances wire wrapped at substantially zero gauge gap, at first and/or second longitudinal ends of the wire wrapped layers, with wire wrapped at a larger gauge in the remaining sections of the layer. These closely wrapped sections effectively form closed cylindrical sections. These closed sections can be more apt to attaching subsequent well screen layers, including mesh layers and outer shroud layers, through bonding (e.g. welding, brazing and/or other) and crimping. Additionally, these closed sections also allow for well screen designs that do away with large well screen connection rings, and other alternative techniques for securing additional layers to wire wrap layers, including alternatives that result in higher labor and material costs.

Figure 1:
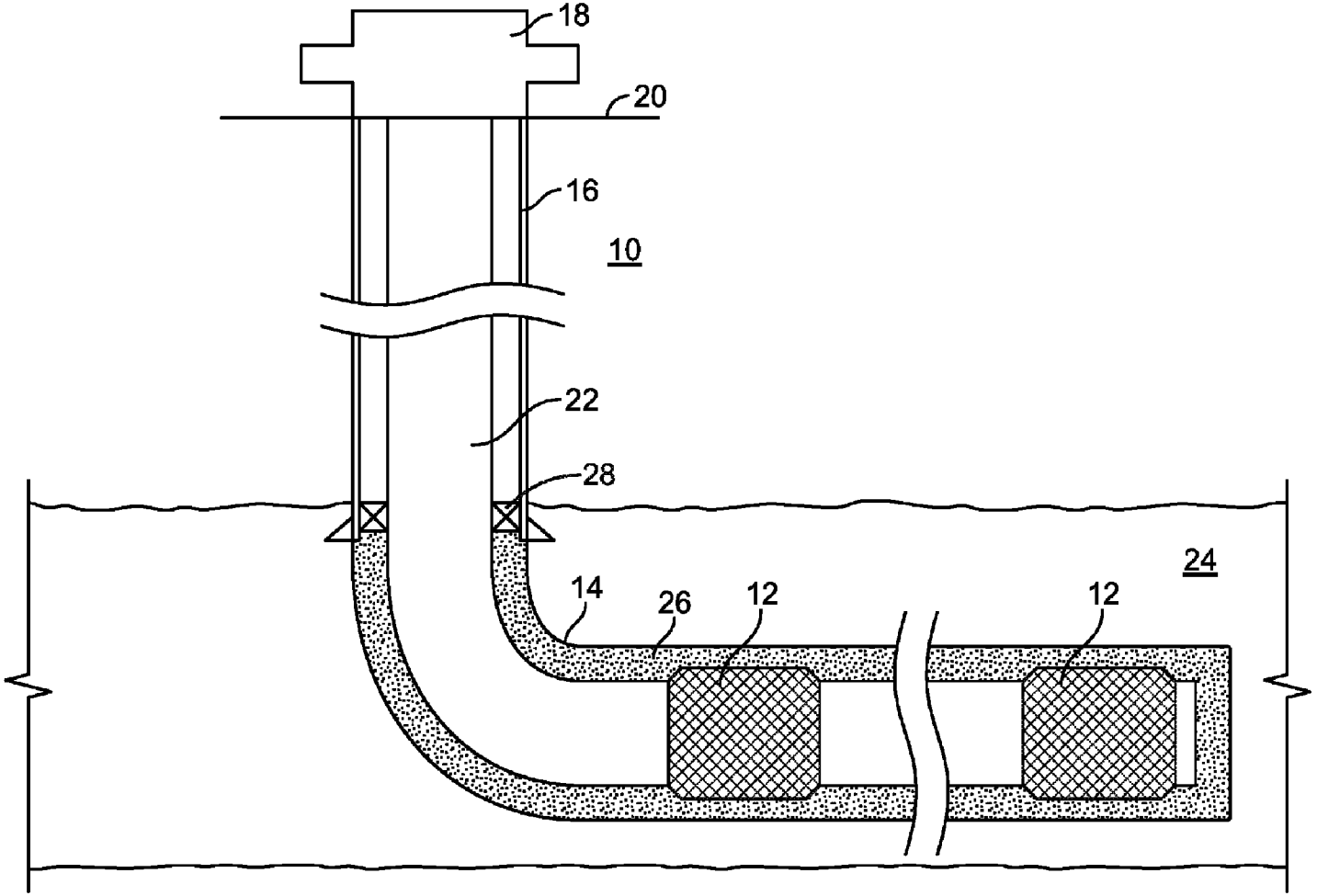
FIG. 1 is a side cross-sectional view of an example well system including a plurality of well screen assemblies.

FIG. 1 illustrates an example well system 10 including a plurality of well screen assemblies 12. The well system 10 is shown as being a horizontal well, having a wellbore 14 that deviates to horizontal or substantially horizontal in the subterranean zone of interest 24. A casing 16 is cemented in the vertical portion of the wellbore and coupled to a wellhead 18 at the surface 20. The remainder of the wellbore 14 is completed open hole (i.e., without casing). A production string 22 extends from wellhead 18, through the wellbore 14 and into the subterranean zone of interest 24. A production packer 28 seals the annulus between the production string 22 and the casing 16. The production string 22 operates in producing fluids (e.g., oil, gas, and/or other fluids) from the subterranean zone 24 to the surface 20. The production string 22 includes one or more well screen assemblies 12 (two shown). In some instances, the annulus between the production string 22 and the open hole portion of the wellbore 14 may be packed with gravel and/or sand (hereinafter referred to as gravel packing 26 for convenience). The well screen assemblies 12 and gravel packing 26 allow communication of fluids between the production string 22 and subterranean zone 24. The gravel packing 26 provides a first stage of filtration against passage of particulate and larger fragments of the formation to the production string 22. The well screen assemblies provide a second stage of filtration, and are configured to filter against passage of particulate of a specified size and larger into the production string 22.

Although shown in the context of a horizontal well system 10, well screen assemblies 12 can be provided in other well configurations, including vertical well systems having a vertical or substantial vertical wellbore, multi-lateral well systems having multiple wellbores deviating from a common wellbore and/or other well systems. Also, although described in a production context, well screen assemblies 12 can be used in other contexts, including injection, well treatment and/or other applications.

Figure 2A:
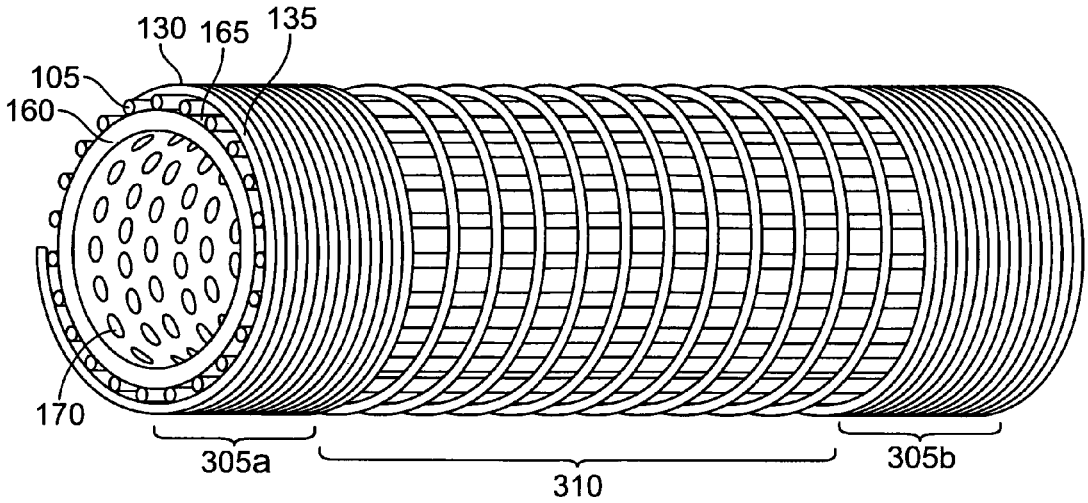
FIG. 2A is a perspective view of an example wire wrap screen and base pipe.

FIG. 2A illustrates a wire wrap screen 130 constructed for use in a well screen assembly, such as well screen assembly 12. The wire wrap screen 130 is shown carried on an apertured base pipe 160. The wire wrap screen 130 can provide a reinforced structural or foundational layer for subsequent layers. The wire wrap screen 130 includes a plurality of supports 105, in some cases longitudinal wires. An additional outer wire or wires 135 is helically wound around the longitudinal supports and bonded (e.g., welded, brazed, and/or otherwise bonded at intersection points) to the supports. The wraps of outer wire 135 cross the longitudinal supports 105 to form a tubular grid. Although shown with a plurality of substantially parallel longitudinal supports 105 oriented axially along the length of the screen 130, the supports 105 can be differently arranged. For example, in some instances, supports 105 can be substantially helical at a lesser pitch than the helical outer wire 135. In the example of FIG. 2A, the perimeter of wire wrapped screen 130 exhibits a substantially circular geometry, but could be other shapes (e.g., polygonal and/or other shapes). In certain instances, the gap between adjacent outer wire wraps 135 can be controlled to be smaller than a specified gap selected to support adjacent layers.

In addition to serving as a support for other layers, the wire wrap screen 130 can enable axial fluid flow between the outer wire wraps 135 and the layers beneath (e.g., base pipe 160). Supports 105 provide stand-off (gap 165) between the outer wire wraps 135 and the layer beneath (here, base pipe 160), allowing for fluid to flow axially within the gap 165. The axial fluid flow encourages better fluid distribution along and into the layer beneath, for example, into the base pipe through base pipe apertures 170. In certain instances, the supports 105 can be a lower gauge wire (i.e., thicker) than the wrapped outer wire 135. The lower gauge wire can provide axial strength to the wire wrap screen, as well as increased standoff between the outer wire 135 and the layer beneath. Additionally, the outer wire 135 and/or the supports 105 can have a circular and/or non-circular (triangular, rectangular, and/or other) cross section. For example, in certain instances, the outer wire 135 has a triangular cross section oriented with a peak of the triangle oriented inward to reduce the likelihood of particulate lodging between adjacent wraps.

Figure 2B:
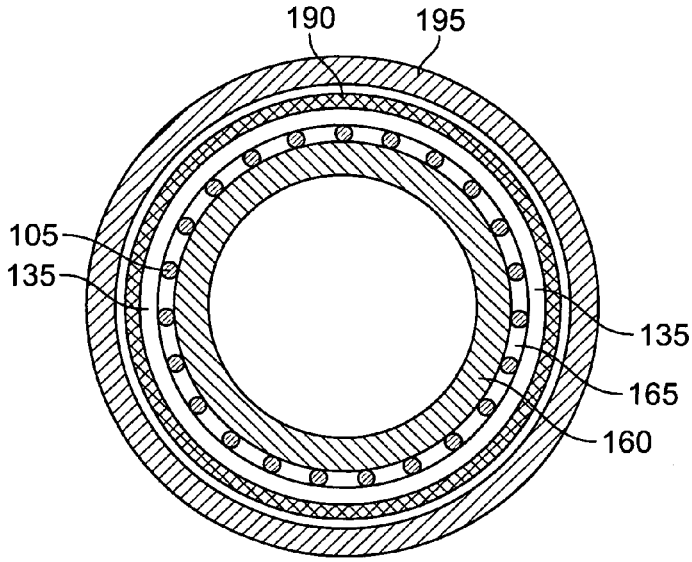
FIG. 2B is a cross-sectional view of a well screen assembly taken intermediate the ends.

In some instances, it may be desirable to use additional layers in conjunction with one or more wire wrap screen layers. For example, as illustrated in FIG. 2B, one or more mesh screen layers 190 could be disposed above a wire wrapped layer 130. Although not specifically shown, one or more mesh screen layers 190 can additionally or alternately be disposed beneath the wire wrapped layer 130. The Mesh of mesh layer 190 is constructed in a different manner than wire wrapped screen layers 130. Rather than constructed of a plurality of longitudinal supports with a wire or wires helically wrapped and bonded to the longitudinal supports, the mesh is typically woven and/or formed of two or more arrays of parallel wires bonded together in opposing relation. The mesh is often formed as a flat sheet. In certain instances, mesh layers 190 have a mesh per inch count of 16 or greater (e.g., 16, 18, 20, 22, 30 and so on), yielding apertures in the mesh that are smaller than (and thus filter against passage of) particulate of a specified size and larger. In certain instances, the mesh layer 190 is selected to filter against passage of a smaller specified size of particulate than would pass the wire wrap screen layers. A vast array of screen materials, weaves, and aperture shapes, sizes, layouts, and patterns exist and can be incorporated as mesh layer 190. Indeed, different mesh layer types, holes sizes, etc. can be combined to customize the filtration characteristics of the screen assembly. Additionally, although wire wrapped layers 130 employing relative high gauge wire, may be quite strong relative a thinner, mesh layer 190, it may nonetheless be desirable to provide additional protective layers, particularly where there are weaker mesh layers 190 disposed on top of the wire wrapped layer 130. For example, a protective shroud layer 195 can be provided, more capable of withstanding the grinding and friction accompanying installation of the assembly down a long wellbore. In certain instances, the shroud layer 195 is an apertured tubing having apertures larger (typically much larger) than the specified size of particulate filtered against passage by the mesh layer 190.

Referring again to FIG. 2A, the wire wrap screen 130 can have two or more sections of different outer wire 135 wrapped at a different wrapping pitch. FIG. 2A shows three sections 305*a*, 305*b*, 310. First and second end sections 305*a*, 305*b* can be characterized by adjacent wire wrappings of the entire section being positioned close together, i.e. wrapped at a high pitch and having a low wrapping gage, while adjacent wire wrappings in section 310 are farther apart, i.e. wrapped at a lower pitch and having a high gage. In some implementations, only one of end sections 305*a* or 305*b* has closely wrapped wire wrap windings. Closely-wrapped windings within the first and/or second end sections 305*a*, 305*b* can be wrapped or positioned with substantially zero gauge (i.e., no gaps or substantially no gaps between adjacent outer wire windings). In some implementations, adjacent outer wire windings within an end section 305*a*, 305*b* may nearly abut, in that the adjacent windings either do not abut or do not abut continuously. The gaps between adjacent windings in the end sections are miniscule, to the point that the smallest particulate filtered against passage by the screen assembly, i.e. the smallest particulate filtered against passage by the mesh layer 190, cannot pass radially or axially (up the helix) between the outer wires 135. In certain instances, the largest gap between adjacent outer wires 135 is equal to or smaller than the smallest size of particulate passed by the screen assembly, such as the smallest size of particulate passed by the wire mesh layer. In some implementations, the substantially zero gage end sections 305*a*, 305*b* can be wrapped or positioned with true zero gage (i.e., no gaps between adjacent outer wire windings). Positioning of wire wrappings within a middle section 310 of wire wrap screen 130 can be controlled to be uniform.

Figure 3A:
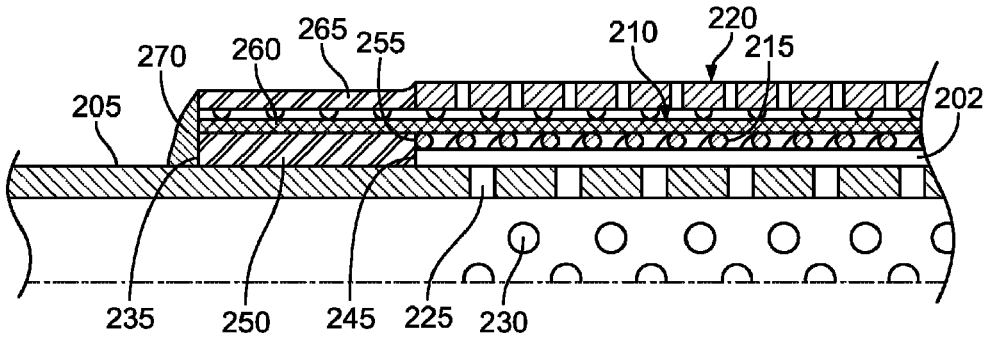
FIG. 3A Prior Art
FIG. 3A is a detail side cross-section view of an end of a prior art well screen assembly.

FIG. 3A illustrates a detail side cross-sectional view of a prior art well screen assembly 202. The view is a detailed view of one end of the well screen assembly 202. Screen assembly 202 includes a protective shroud layer 220, on top of and around a traditional wire wrap screen layer 215 and a mesh layer 210, all carried on a base pipe 205. Traditional wire wrap screen layer 215 is of entirely uniform wrapping gage. While these filtration layers can be well-equipped to filter against particulates entering base pipe apertures (e.g., 225, 230) from the radial direction of the pipe 205, the end 235 of the screen layers must be sealed to the base pipe 205 to prevent particulate from entering axially at the well screen end 235.

FIG. 3A illustrates one approach to sealing the end 235 of a well screen assembly 202 incorporating a wire wrap layer 215. The end 245 of the wire wrap layer 215 is welded 255 to a sealing ring 250, allowing for an end portion 260 of the mesh layer 210 and an end portion 265 of the shroud layer 220 to be carried on top of the ring 250. Additionally, in some instances, the end portion 265 of the shroud layer 220 can be radially crimped onto the mesh layer 210 and sealing ring 250, to trap and seal the end portion 260 of the mesh layer 210 between the ring 250 and shroud layer end section 265. Crimping the end portion 265 of the shroud layer 220 can also serve to bind the ring 250 to the outer surface of the base pipe 205, thereby securing the screen layers to the base pipe 205. Additionally, a circumferential weld 270 can be provided in addition to the crimp to further secure and seal the screen layers (wire wrap layer 215, mesh layer 210, and shroud layer 220) to the base pipe 205, as well as reinforce the binding and prevent axial particulate leakage between the screen layers.

Figure 3B:
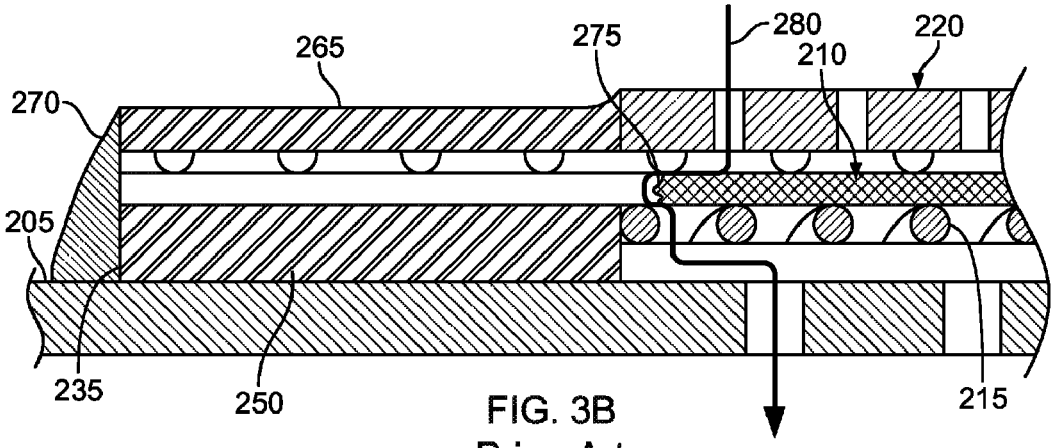
FIG. 3B Prior Art
FIG. 3B is a detail side cross-section view of an end of the prior art well screen assembly of FIG. 3A showing a particulate leak path.

Some mesh layers 210 can be thin and susceptible to melting, scorching, and other damage when welded, causing axial openings and flaws to develop in the mesh 210. As illustrated in FIG. 3B, if a mesh layer opening 275, caused by damage from a weld 270, extends axially beyond the width of the crimped sealing ring 250, this opening 275 can compromise the seal, providing a path 280 for particulate to enter the pipe 205. Particulate entering through path 280 would normally be filtered by layer 210, but an opening 275 caused by scorching allows the flow path 280 to circumvent the mesh layer 210.

Figure 4:
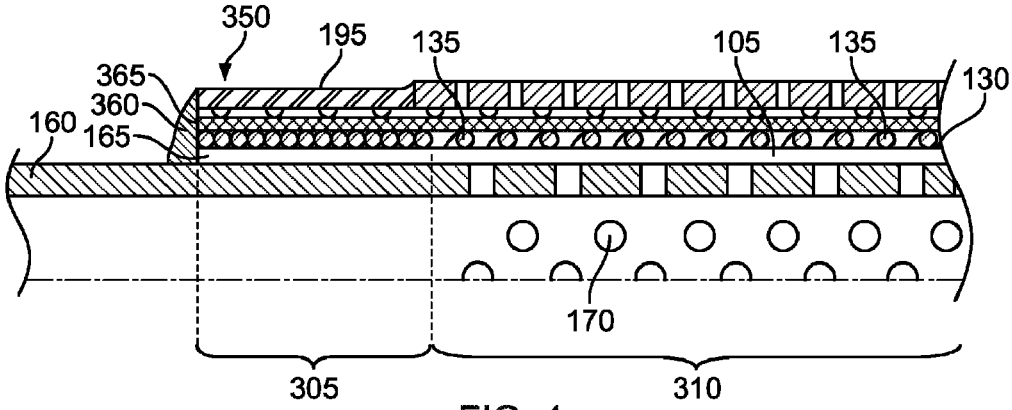
FIG. 4 is a detail side cross-sectional view of an example well screen assembly.

FIG. 4 illustrates a detail side cross-sectional view of an example well screen assembly incorporating a wire wrap screen layer 130 similar to that of FIG. 2A. FIG. 4 shows one end of the well screen assembly. The opposing end can be similarly constructed. Adjacent windings of outer wire 135 are closely wrapped (shown at substantially zero gauge) in end section 305 and provide an effectively closed surface upon which additional layers can be attached. Such end sections 305 can replace sealing rings, such as ring 250 illustrated in FIG. 3A. As shown in FIG. 4, end section 305 of wire wrap layer 130 can correspond with the end section of mesh layer 190 and outer shroud layer 195. Additionally, the end section of outer shroud layer 195 can be crimped so as to pinch and secure the layers, such as a wire mesh layer 190, between the zero gauge end section 305 and the end section of outer shroud layer 195. A weld 360 can be provided around a circumference of screen layers end 365. Weld 360 can seal against entry of particulate, axially, through end 365. For example, weld 360 seals against passage of particulate through the gap 165 provided by supports 105, between base pipe 160 and outer wire 135. The assembly is sealed when particulates with diameters larger than the screen apertures of the finest filtration layer of the assembly, cannot bypass the filtration screens and enter the base pipe. The end of base pipe 160 can be threaded or otherwise provisioned to couple to other lengths of tubing.

The number of outer wire windings forming the end section 305 of the wire wrap layer can vary according to the length and requirements of the well screen assembly. For example, one can provide an end section 305 with an axial width w large enough to insure against developing axial openings in the additional layers that result in circumvention of the additional layers, as described in FIG. 2B in connection with path 280. Additionally, the number of windings 195 included in end section 305, and accordingly the width w of end section 305, may be selected based on the size of the crimp (at shroud end 350) needed to secure the layers to the base pipe.

A number of embodiments of the invention have been described. Nevertheless, it will be understood that various modifications may be made without departing from the spirit and scope of the invention. Accordingly, other embodiments are within the scope of the following claims.

What is claimed is:

1. A well screen assembly, comprising:

an elongate base pipe;

a wire wrap layer comprising a wire wrapped around the base pipe, the wire wrap layer having a first axial end section wrapped at a first gage, a second axial end section wrapped at a second gage, and an intermediate section between the first and second axial end sections wrapped at a third gage that is larger than the first and second gages;

a mesh filtration layer around the wire wrap layer; and an outer shroud around the mesh filtration layer, the outer shroud sealed to the wire wrap layer.

2. The well screen assembly of claim 1, wherein an end of the outer shroud is crimped about the mesh filtration layer, the axial end section of the wire wrap layer and the base pipe, and the well screen is sealed against passage of particulate between the outer shroud and the base pipe.

3. The well screen assembly of claim 1, wherein the first gage is substantially zero gage.

4. The well screen assembly of claim 1, wherein the first axial end section of the wire wrap layer comprises adjacent wraps of wire that are abutting.

5. The well screen assembly of claim 1, wherein a gap between adjacent windings of wire in the first axial end section is equal to or smaller than a smallest aperture in the mesh layer.

6. The well screen assembly of claim 1, wherein the first and second axial end sections are wrapped at substantially zero gauge.

7. The well screen assembly of claim 1, wherein substantially all of the intermediate section has a substantially uniform gauge.

8. The well screen assembly of claim 1, wherein the wire wrap layer, the mesh filtration layer, and the outer shroud terminate at or near the first axial end section to form a first layer end, and the well screen assembly further comprising a weld at the first layer end, binding and sealing the first layer end to the base pipe.

9. The well screen assembly of claim 1, wherein the outer shroud is apertured tubing.

10. A well screen assembly, comprising:

a plurality of support ribs; and a wire coiled around and bonded to the support ribs, a spacing between adjacent coil windings in end sections of the wire coil operable to filter against passage of particulate of a specified size, and a spacing between adjacent coil windings in an intermediate section of the wire coil operable to allow particulate of the specified size to pass.

11. The well screen assembly of claim 10 further comprising a mesh layer around the wire coil, the mesh layer operable to filter against passage of particulate of the specified size and larger.

12. The well screen assembly of claim 11, further comprising a shroud layer around the mesh layer and crimped near the end sections of the wire coil sealing the mesh layer between the wire wrap layer and shroud layer.

13. The well screen assembly of claim 12, further comprising a weld affixing the shroud layer to the wire coil.

14. The well screen assembly of claim 10, wherein the end sections comprise substantially zero gage coil windings.

15. A method for making a well screen assembly, the method comprising:

fitting an elongate base pipe with a wire wrap screen layer comprising a wire coil bonded to longitudinal ribs, wherein adjacent coil windings in opposing end sections of the coil are positioned at substantially zero gage, and coil windings in an intermediate section of the coil wire positioned at a non-zero gage;

wrapping at least one mesh layer over the wire wrap screen layer so that the longitudinal dimension of the mesh layer extends to overlap at least the opposing end sections;

providing a rigid shroud layer over the at least one mesh layer, the longitudinal dimension of the rigid shroud layer extending to overlap at least the opposing end sections underlying the at least one mesh layer; and crimping the shroud layer about the opposing end sections underlying the at least one mesh layer and rigid shroud layer to pinch and seal the at least one mesh layer between the wire wrap screen layer and the rigid shroud layer.

16. The method of claim 15, wherein crimping the rigid shroud layer secures the wire wrap screen layer between the shroud layer and the base pipe.

17. The method of claim 15, further comprising welding ends of each of the wire wrap screen layer, mesh layer, and shroud layer to the base pipe.

18. A well screen assembly, comprising:

an elongate base pipe;

a wire wrap layer comprising a wire wrapped around the base pipe, the wire wrap layer having an axial end section wrapped at a first gage and an intermediate section wrapped at a second, larger gage;

a mesh filtration layer around the wire wrap layer; and an outer shroud around the mesh filtration layer, the outer shroud sealed to the wire wrap layer, and wherein the wire wrap layer further comprises a second axial end section wrapped at substantially zero gauge, and wherein the intermediate section is disposed between the first and second axial end sections.

19. A method for making a well screen assembly, the method comprising:

fitting an elongate base pipe with a wire wrap screen layer comprising a wire coil bonded to longitudinal ribs, wherein adjacent coil windings in a first section of the coil are positioned at substantially zero gage, and coil windings in a second section of the coil wire positioned at a non-zero gage;

wrapping at least one mesh layer over the wire wrap screen layer so that the longitudinal dimension of the mesh layer extends to overlap at least the first coil section;

providing a shroud layer over the at least one mesh layer, the longitudinal dimension of the shroud layer extending to overlap at least the first coil section underlying the at least one mesh layer; and crimping the shroud layer about the first coil section underlying the at least one mesh layer and shroud layer to pinch and seal the at least one mesh layer between the wire wrap screen layer and the shroud layer, and wherein the wire wrap screen layer further comprises a third coil section, wherein adjacent coil windings in the third coil section are positioned at substantially zero gage, and wherein the second section of the coil is disposed between the first and third sections.

20. The method of claim 19, wherein the longitudinal dimension of each of the mesh layer and shroud layer extends to overlap both the first and third coil section, the method further comprising crimping the shroud layer about the third coil section.

* * * * *